United States Patent [19]

Bohnenkamp

[11] 4,375,998

[45] Mar. 8, 1983

[54] METHOD AND APPARATUS FOR COOLING METAL STRIP WOUND INTO COILS

[75] Inventor: Heinrich Bohnenkamp, Neuss-Uedesheim, Fed. Rep. of Germany

[73] Assignee: SMS Schloemann-Siemag Aktiengesellschaft, Dusseldorf, Fed. Rep. of Germany

[21] Appl. No.: 250,841

[22] Filed: Apr. 3, 1981

[30] Foreign Application Priority Data

Apr. 15, 1980 [DE] Fed. Rep. of Germany ..... 3014362

[51] Int. Cl.[3] ..... C21D 1/62

[52] U.S. Cl. ..... 148/157; 266/259; 266/46; 432/85; 148/153

[58] Field of Search ..... 266/259, 260, 114, 249, 266/112, 113, 44, 46; 148/143, 153, 155, 157; 432/77, 85

[56] References Cited

U.S. PATENT DOCUMENTS

| | | | |
|---|---|---|---|
| 2,657,036 | 10/1953 | Nichols | 266/251 |
| 2,781,188 | 2/1967 | McKeown | 266/251 |
| 3,442,029 | 5/1969 | Adair | 34/105 |
| 3,832,129 | 8/1974 | Derbyshire et al. | 432/77 |

*Primary Examiner*—L. Dewayne Rutledge
*Assistant Examiner*—Christopher W. Brody
*Attorney, Agent, or Firm*—Holman & Stern

[57] ABSTRACT

Coils of metal strip are cooled by being placed on porous supports with the coil axes vertical. Water is introduced into the coil interiors and most of the water overflows the coil tops and thereby cools the coil tops and peripheries. A small proportion of the water flows out through the porous supports and thereby cools the bottom ends of the coils. The water is preferably introduced from below. Apparatus for performing cooling is disclosed.

7 Claims, 5 Drawing Figures

METHOD AND APPARATUS FOR COOLING METAL STRIP WOUND INTO COILS

BACKGROUND OF THE INVENTION

Hot-rolled metal strip is wound into coils immediately after the rolling operation and then has to be cooled. Once it has been wound into coils, the metal strip cools only slowly and a large area is therefore needed for storing the coils during the cooling process. With steel strip, in particular, slow cooling in the open air is also disadvantageous as a thick, hard layer of scale would form on the strip and, in addition to the disadvantage of considerable wastage of material, this would also complicate the pickling process necessary before further processing of the strip, for example by cold rolling. It is therefore usual to cool the coils of wound metal strip quickly using water, and this used to be effected by immersing the coils in water or by sprinkling or spraying the coils with water. The quantity and type of scale is favourably influenced by rapid cooling. Thus, scale is formed to a particularly significant extent in the case of steel at temperatures ranging between 750° and 450° C. and the quantity of scale is smaller, the shorter the time the strip remains in this temperature range. In addition, the free atmospheric oxygen is prevented from reaching the metal during immersion of the coils and this also suppresses the formation of scale.

This cooling operation with water surrounding the coils on all sides is therefore given preference. The disadvantage of this cooling operation lies in the fact that the apparatuses required are very complicated, therefore expensive and, as they have to function in part under water, also require maintenance. Another disadvantage is that the coils cannot be observed visually when they are immersed.

The object of the invention is to permit rapid cooling of the coils while simultaneously preventing the admission of free oxygen and enabling the coils to be observed visually in a simple manner.

SUMMARY OF THE INVENTION

The invention provides a method of cooling a coil of metal strip, in which said coil is placed, with its axis substantially vertical, on a porous support with the lower face of the coil standing on the support, a stream of water is introduced into the interior of the coil to fill the said interior, a minor proportion of the water flows from the coil interior along the said lower face by way of the said support, and a major proportion of the water flows over the upper face of the coil and over the peripheral surface of the coil.

By this method, very effective cooling is achieved with a small quantity of water at very little expense.

If the coils to be cooled are relatively narrow, several coils can be stacked coaxially. In this case, a further improvement in the cooling operation is achieved if the plurality of narrow coils are superimposed with the interposition of porous intermediate layers through which flows a small proportion of the water for cooling the adjacent coil end faces.

As explained, it is possible to carry out the method using simple means. Thus, the method can be carried out most simply by placing the coils to be cooled on a bed of gravel and charging them, from above, with the stream of coolant conveyed into the interior of the coil, in which case, however, the water supply means would have to be removed during transporting of the coils to and from the gravel bed. Preferably therefore the water is supplied from below.

Another possible way of carrying out the method involves depositing the coils on plate-like pallets provided with a porous covering and driving them with these pallets into and out of cooling stations, the coolant stream being conveyed from above or from below, through a bore provided in the centre of the plate, into the coil interior. Conventional conveyors (apron conveyors, trolleys capable of travelling on rails or even stacker trucks) can be used for transporting the pallets and the pallets with the coils.

For carrying out the method, however, it is preferable to use an apparatus designed according to another feature of the invention, which is distinguished by low constructional costs and minimum maintenance and which can therefore be operated simply and inexpensively. The apparatus according to the invention consists of a grid which is designed as a collector or covers a collecting hopper for the issuing coolant, which acts as a support for a single-part or multiple-part coil support plate in which each coil position is provided with a bore, the plate bearing porous coverings, and supply pipes fed with the coolant being connected to the bores in the plate.

To ensure optimum cooling and, at the same time, to prevent air reaching the strip to be cooled, the coils to be cooled should be surrounded all round and completely, as far as possible, by the coolant. To make this absolutely certain for the lower end face, each coil position of the support plate is provided, according to another feature of the invention, with a collar defining the coil position, which holds the porous covering material together and whose height exceeds the thickness of the porous covering and thus maintains a water level situated above the bottom support surface of the coil resting on the porous covering.

According to another feature of the invention, the support plates can be designed very simply as annular discs with a collar located at the outer edge. Such discs with collars can act as the plate-like pallets if the coils are placed on pallets for transportation purposes on which they remain during the cooling operation, as described above.

One manner of carrying out the present cooling method and the apparatus used for it are illustrated in two embodiments.

DETAILED DESCRIPTION OF THE INVENTION

Figure 1:
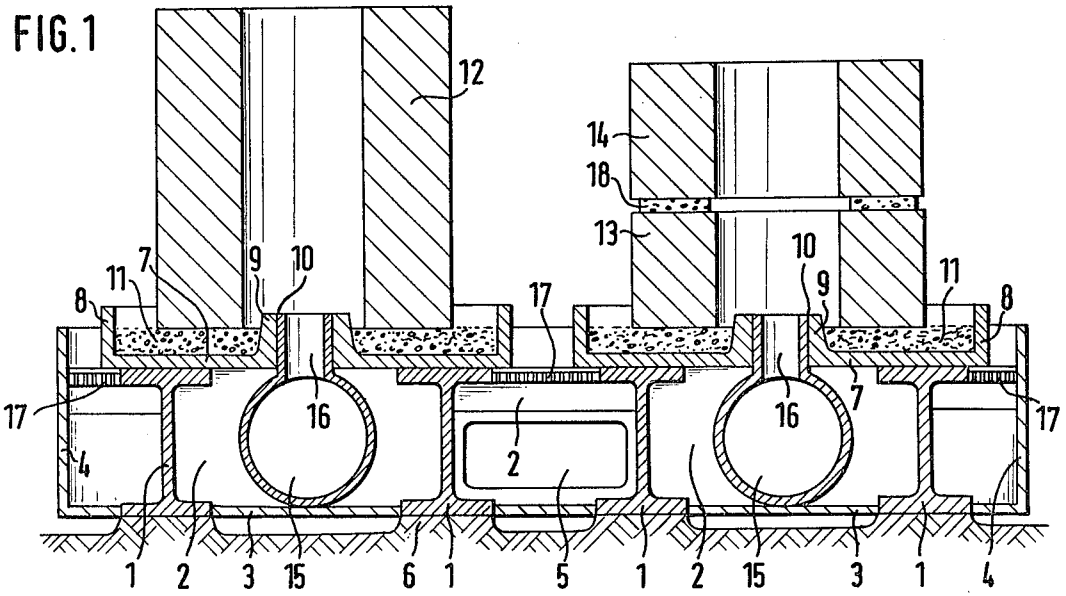
FIG. 1 shows a section through an apparatus for cooling metal strip coils.

FIG. 1 shows coil cooling apparatus comprising a support grid composed of longitudinal beams 1 and transverse beams 2. The grid is sealed at the bottom and defined at the sides by base plates 3 and side walls 4, and forms a collector for used coolant, which flows through openings in the longitudinal beams 1 to an outlet 5 and is conveyed from there to a central coolant station in order to be processed. The grid formed by the longitudinal beams 1 and transverse beams 2 rests on a bed 6 and, in turn, carries support plates 7. These plates 7 are annular discs each provided with an upstanding flange or collar 8 at the outer edge and with an eye 9 and a bore 10 in the centre. A layer 11 of porous material, for example gravel of a suitable particle size, is placed on the plates 7 to a thickness which is somewhat smaller than the height of the collar 8. The coils 12, 13 and 14 to be cooled are placed approximately centrally with vertical axes on the porous layer 11. Coolant is supplied from the central coolant station via pipes 15 and issues from connecting nozzles 16 of the pipes 15. The plates 7 are seated on the connecting nozzles 16, the nozzles 16 fitting in the bores 10. The coolant issuing from the connecting nozzles 16 fills the interior of the coils 12 or 13 and 14, as the particle size of the gravel layer 11 and therefore the porosity thereof is selected in such a way that only a relatively small proportion of the coolant issuing through the connecting nozzles 16 runs out through this layer 11. The larger proportion of the coolant therefore runs over the upper faces of the coils 12 and 14 and then along the outer periphery of the coils 12 or 13 and 14, the quantity of water issuing being calculated so as to produce unbroken layers of flowing coolant surrounding the coils all round. The smaller proportion of coolant flows through the layers 11 along the lower faces, i.e. the support surfaces of the coils 12 and 13 and cools them. To maintain unbroken layers of coolant also on these faces, the plates 7 are provided with collars 8 which maintain a minimum water level above the support surfaces. Where the grid is not covered by the plates 7, gratings 17 are provided which make the grid accessible for the operators but which permit the issuing coolant to flow out into the collecting chamber to the outlet 5.

Figure 2:
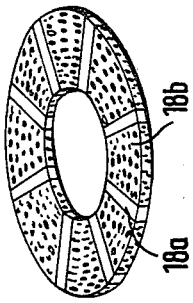
FIG. 2 shows in detail a porous intermediate or bottom layer.

If narrow coils 13 and 14 are to be cooled and if they are stacked coaxially, it is advisable to use a porous intermediate layer 18. The porosity of the intermediate layer is calculated in such a way that only a relatively small proportion of the coolant stream can flow out through the intermediate layer 18, this proportion being sufficient to cool the opposing end faces of the superimposed coils 13 and 14 and to wet them as completely as possible, although the larger proportion of the coolant stream issues via the end face of the coil 14 situated at the top. FIG. 2 shows an embodiment of such an intermediate layer 18. The intermediate layer consists of spacer members 18*a* composed of asbestos cement or a similar heat-resistant material and porous fillings 18*b* arranged between them and connected to the spacer members 18*a*, for example of link chains with interwoven asbestos strands. Intermediate layers 18 of this type can obviously also be used as bottom layers instead of the gravel layer 11.

Figure 3:
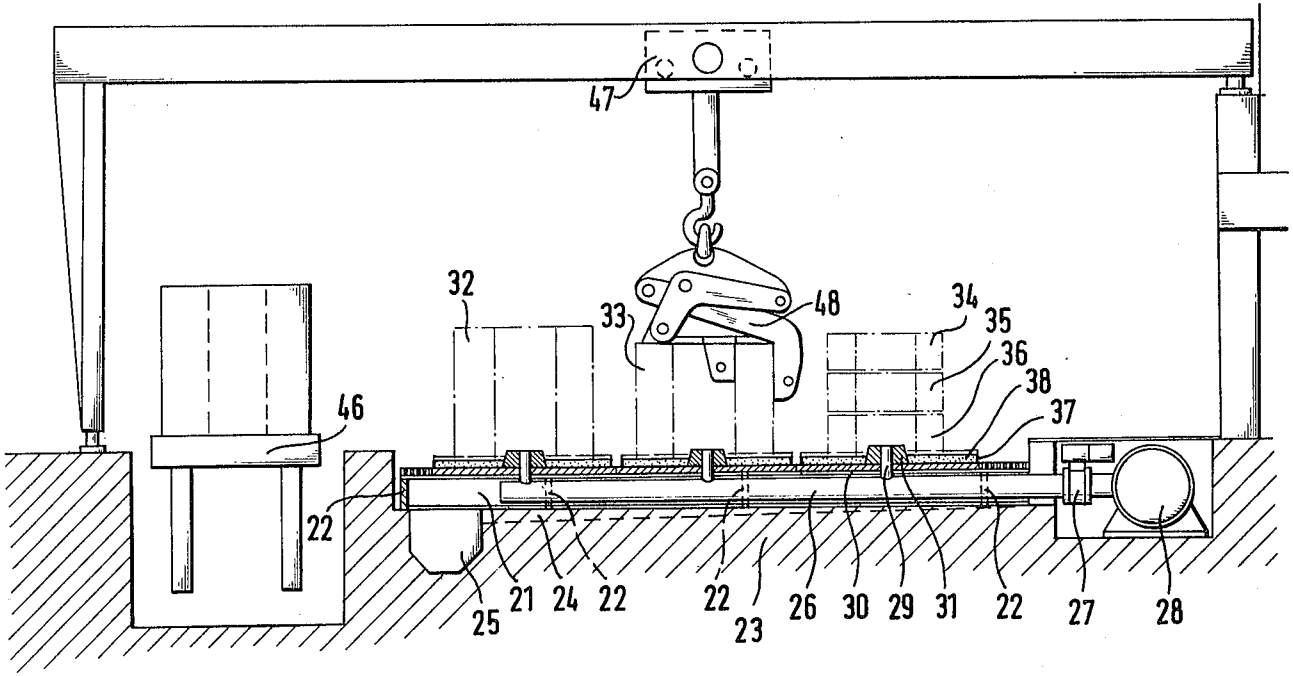
FIG. 3 shows another coil cooling apparatus in section.
Figure 5:
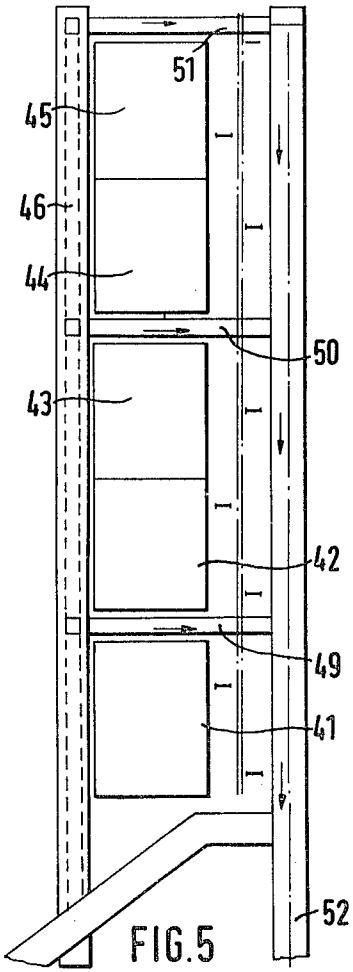
FIG. 5 shows a plan view of a cooling installation composed of several individual cooling apparatuses.
Figure 4:
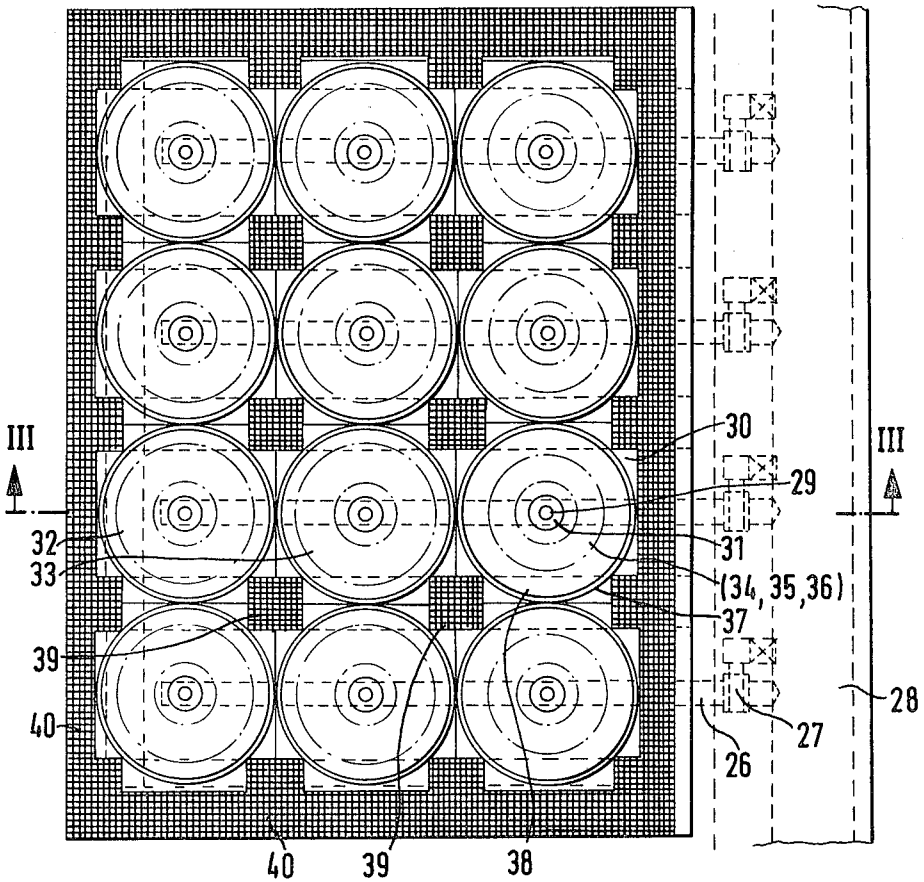
FIG. 4 shows a plan view of a cooling apparatus according to FIG. 3.

In the embodiment illustrated in FIGS. 3 to 5, each coil cooling apparatus consists of a grid which is composed of longitudinal beams 21 and transverse beams 22. This grid is open at the bottom and lies on a bed 23 which is provided with outlet channels 24 and a collecting channel 25 as collecting hopper for the issuing coolant, which are bridged over by the grid. In the grid there are inserted, parallel to the longitudinal beams 21, pipes 26 for the supply of coolant which are connected via control and stop valves 27 to a pipe 28 belonging to the central coolant supply. The pipes 26 are provided with a connecting nozzle 29 for each standing position for coils to be cooled. Support plates 30 which each have a bore for the passage of a connecting nozzle 29 lie on the grid formed by the longitudinal beams 21 and the transverse beams 22. Sleeves 31 placed on the end of each connecting nozzle 29 serve to protect the connecting nozzles 29, for sealing the connecting nozzles 29 from the plates 30, and for approximately centering the coils 32, 33, 34, 35, 36 which are to be cooled and which are placed on the plates 30. Collars 37 are placed on the plates 30 and a layer of gravel 38 is arranged on the plates 30 inside these collars 37. Between the plates 30 and right round them, along the outer rim of each cooling apparatus there are placed on the grid formed by the longitudinal beams 31 and transverse beams 32 gratings 39 and 40 which allow the coolant to flow out and make the grid accessible to the operators. The apparatus operates in the same way as the apparatus in the embodiment according to FIG. 1.

As shown in FIG. 5, several cooling apparatuses of the type described above can be arranged next to each other in the required number, five apparatuses 41, 42, 43, 44 and 45 in this case, and the number of coil positions in each apparatus can be made larger or smaller by varying the lengthwise and transverse dimensions of the apparatuses. The apparatuses are loaded by means of conveyors, for example an apron conveyor 46 which connects the cooling apparatuses to the rolling mill. The cooling apparatuses 41 to 45 lie, together with the end of the conveyor 46, in the operating zone of a crane 47. The coils can be conveyed by means of a grab 48 from the conveyor 46 directly onto the cooling apparatuses 41 to 45, or the coils are initially transferred from the conveyor 46 onto additional (secondary) apron conveyors 49, 50 and 51 arranged transversely between the cooling apparatuses 41 to 45 and removed therefrom by the grab 48 of the crane 47 and deposited on the cooling apparatuses. The secondary conveyors 49 to 51 are used for removing the cooled coils and they transfer the coils to an additional (tertiary) apron conveyor 52 which then conveys the coils to a storage position.

I claim:

1. A method of cooling a coil of metal strip, in which said coil is placed, with its axis substantially vertical, on a porous support with the lower face of the coil standing on the support, introducing a stream of water into the interior of the coil to fill the said interior, a minor proportion of the water flowing from the coil interior along the said lower face by way of the said support, and a major proportion of the water flowing over the upper face of the coil and over the peripheral surface of the coil.

2. A method according to claim 1 in which a plurality of narrow coils are disposed in a stack with a common substantially vertical axis and a porous intermediate layer is disposed between adjacent coils in the stack whereby a small proportion of the water introduced into the interior of the coils flows through said porous intermediate layer for cooling coil end faces adjacent thereto.

3. A method according to claim 1 or 2 in which the water is introduced into the coil interior from below.

4. Apparatus for cooling cylindrical coils of metal strip, comprising a support grid, liquid coolant discharge means associated with the support grid, at least one cylindrical coil support plate supported by the grid and defining at least one cylindrical coil position, at least one liquid coolant supply aperture at each said cylindrical coil position, liquid coolant supply means communicating with said at least one liquid coolant supply aperture for delivering liquid coolant to the interior of a cylindrical coil standing at said cylindrical coil position, and a porous cylindrical coil support at each said cylindrical coil position providing a radial flow path for the liquid coolant across the bottom surface of said cylindrical coil.

5. An apparatus according to claim 4 in which the said at least one plate, for each coil position, is provided with a collar defining the coil position which collar holds together the porous support and is of a height exceeding the thickness of the porous support for maintaining a water level situated above the bottom surface of the coil standing on the porous support.

6. An apparatus according to claim 5 in which each coil position is designed as an annular disc with said collar located at the outer edge.

7. An apparatus according to claim 4, 5, or 6, in which the liquid coolant comprises water and the liquid coolant supply aperture communicates with the bottom of the cylindrical coil interior, so that at least a portion of the supplied water is caused to rise within the cylindrical coil interior and overflow at the top thereof to surround completely the top and side surfaces of the outer cylindrical coil layers.

* * * * *